US010354783B2

(12) United States Patent
Griffin

(10) Patent No.: US 10,354,783 B2
(45) Date of Patent: Jul. 16, 2019

(54) MISMATCHED MOV IN A SURGE SUPRESSION DEVICE

(71) Applicant: Transtector Systems, Inc., Hayden, ID (US)

(72) Inventor: Adam Griffin, Greenacres, WA (US)

(73) Assignee: TRANSTECTOR SYSTEMS, INC., Hayden, ID (US)

( * ) Notice: Subject to any disclaimer, the term of this patent is extended or adjusted under 35 U.S.C. 154(b) by 0 days.

(21) Appl. No.: 16/006,741

(22) Filed: Jun. 12, 2018

(65) Prior Publication Data

US 2018/0366245 A1 Dec. 20, 2018

Related U.S. Application Data

(60) Provisional application No. 62/520,813, filed on Jun. 16, 2017.

(51) Int. Cl.
*H01C 7/12* (2006.01)
*H01H 85/04* (2006.01)
*H01C 1/14* (2006.01)

(52) U.S. Cl.
CPC ..... *H01C 7/12* (2013.01); *H01C 1/14* (2013.01); *H01H 85/04* (2013.01)

(58) Field of Classification Search
CPC ..... H01C 7/12; H01C 1/17
USPC ..... 338/21
See application file for complete search history.

(56) References Cited

U.S. PATENT DOCUMENTS

| | | | | |
|---|---|---|---|---|
| 5,130,884 | A * | 7/1992 | Allina | H01R 13/6666 361/117 |
| 5,392,188 | A * | 2/1995 | Epstein | H02H 9/04 361/111 |
| 7,623,019 | B2 * | 11/2009 | Luo | H01C 13/02 252/518.1 |
| 8,378,778 | B2 * | 2/2013 | Duval | H01C 7/126 338/13 |
| 10,062,534 | B2 * | 8/2018 | D'Ippolito | H01C 7/126 |
| 10,128,028 | B2 * | 11/2018 | Hsu | H01C 1/144 |
| 2006/0245125 | A1 * | 11/2006 | Aszmus | H01C 7/126 361/56 |
| 2014/0092514 | A1 * | 4/2014 | Chen | H01C 7/12 361/118 |
| 2015/0171622 | A1 * | 6/2015 | Lee | H01C 7/126 361/93.7 |

* cited by examiner

*Primary Examiner* — Kyung S Lee
(74) *Attorney, Agent, or Firm* — Snell & Wilmer LLP

(57) ABSTRACT

A device for dissipating a surge includes at least three metal oxide varistors (MOVs). Each of the MOVs may be positioned adjacent to each other. Each of the MOVs may have two contact surfaces. Contact surfaces of adjacent MOVs are electrically connected together. The at least three MOVs include a first outer MOV, a second outer MOV, and at least one inner MOV positioned between the first outer MOV and the second outer MOV. The first outer MOV and the second outer MOV have a greater voltage at a given current than at least one of the at least one inner MOV. The device further includes a first connector electrically coupled to at least one of the at least three MOVs. The device further includes a second connector electrically coupled to at least another of the at least three MOVs.

20 Claims, 8 Drawing Sheets

MISMATCHED MOV IN A SURGE SUPRESSION DEVICE

CROSS-REFERENCE TO RELATED APPLICATIONS

This application claims the benefit and priority of U.S. Provisional Application No. 62/520,813, entitled "MISMATCHED MOV IN A SURGE SUPPRESSION DEVICE," filed on Jun. 16, 2017, the entire disclosure of which is hereby incorporated by reference herein in its entirety.

BACKGROUND

1. Field

The invention relates to surge suppression devices and, more particularly, to a stack of metal oxide or silicon carbide varistors (MOVs) connected in parallel for dissipating a surge signal.

2. Description of the Related Art

Metal oxide or silicon carbide varistors (MOVs) have properties that make them desirable for use as surge protectors. In particular, MOVs can absorb surge energy and dissipate the energy as heat. If relatively large surge suppression is desirable, multiple MOVs can be connected in parallel. It is commonly believed that such a parallel configuration of MOVs will provide surge protection that is equal to a sum of the total surge protection rating of each of the connected MOVs. However, experimentation has shown that this is untrue; a collection of matched MOVs connected in parallel provides less surge protection than a sum of the total surge protection rating of each of the connected MOVs. Therefore, it is desirable to develop a surge protection device that includes multiple MOVs connected in parallel and that achieves a maximum surge protection rating.

SUMMARY

A device for dissipating a surge includes at least three metal oxide or silicon carbide varistors (MOVs). Each of the MOVs may be positioned adjacent to each other. Each of the MOVs may have two contact surfaces. Contact surfaces of adjacent MOVs are electrically connected together. The at least three MOVs include a first outer MOV, a second outer MOV, and at least one inner MOV positioned between the first outer MOV and the second outer MOV. The first outer MOV and the second outer MOV have a greater voltage at a given current than at least one of the at least one inner MOV. The device further includes a first connector electrically coupled to at least one of the at least three MOVs. The device further includes a second connector electrically coupled to at least another of the at least three MOVs.

Also described is a device for dissipating an electrical surge. The device includes at least three metal oxide or silicon carbide varistors (MOVs) positioned adjacent to each other and electrically connected together in parallel and including two outer MOVs and at least one inner MOV that has less voltage at a given current than the two outer MOVs. The device further includes a first connector electrically coupled to at least one of the at least three MOVs and configured to be coupled to a signal line or a neutral line. The device further includes a second connector electrically coupled to at least another of the at least three MOVs and configured to be coupled to the other of the signal line or the neutral line.

Also described is a device for dissipating a surge. The device includes at least three metal oxide or silicon carbide varistors (MOVs) positioned adjacent to each other and including a first outer MOV, a second outer MOV, and a center MOV having a greater voltage at a given current than the first outer MOV and the second outer MOV. The device further includes a plurality of contacts including a first contact electrically connected to an outer contact surface of the first outer MOV, a second contact electrically connected to the outer contact surface of the second outer MOV, and additional contacts located between each adjacent pair of MOVs. The device further includes a first connector electrically coupled to a first group of the plurality of contacts. The device further includes a second connector electrically coupled to a second group of the plurality of contacts such that the at least three MOVs are electrically connected in parallel.

BRIEF DESCRIPTION OF THE DRAWINGS

The features, objects, and advantages of the invention will become more apparent from the detailed description set forth below when taken in conjunction with the drawings, wherein.

DETAILED DESCRIPTION

Apparatus, systems and methods that implement the embodiments of the various features of the invention will now be described with reference to the drawings. The drawings and the associated descriptions are provided to illustrate some embodiments of the invention and not to limit the scope of the invention. Throughout the drawings, reference numbers are re-used to indicate correspondence between referenced elements. In addition, the first digit of each reference number indicates the figure in which the element first appears.

Figure 1:
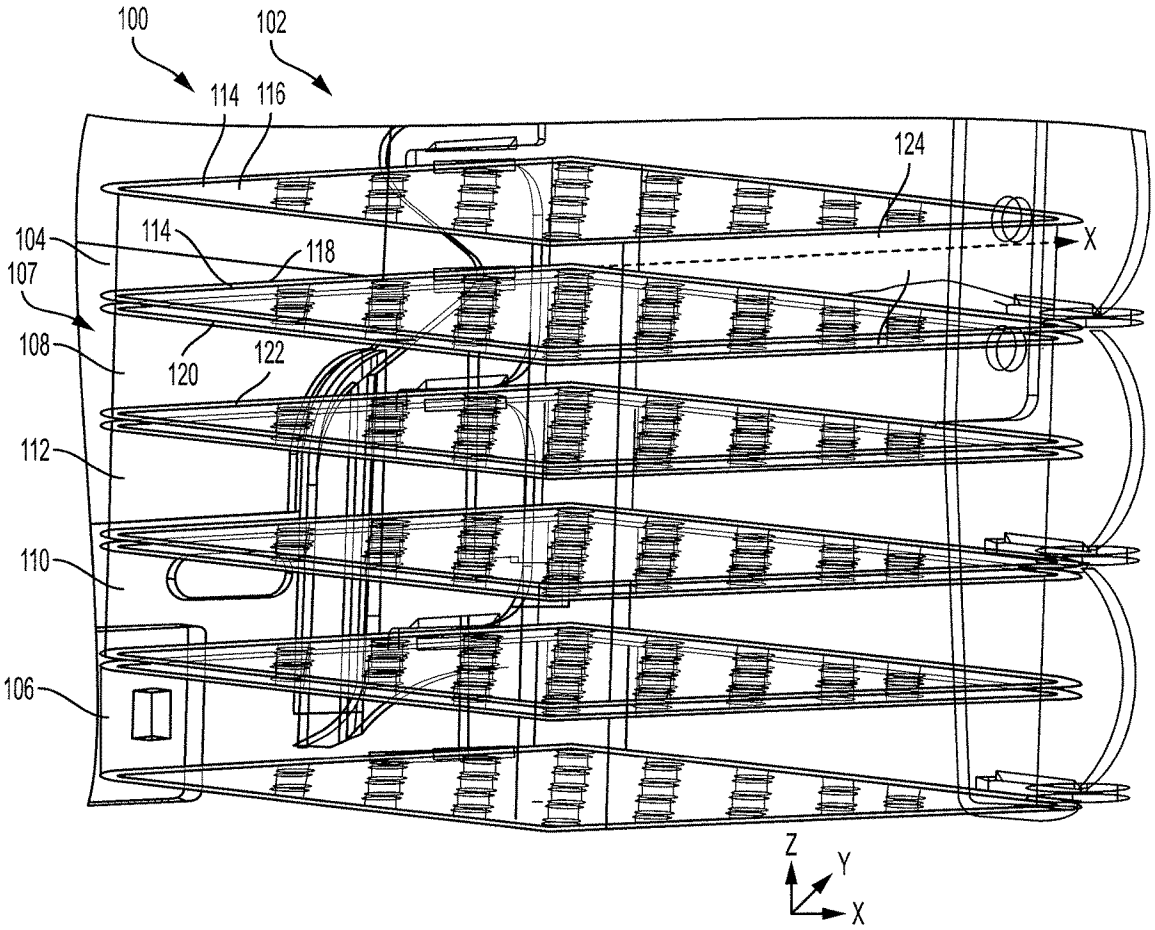
FIG. 1 is a cross-sectional view of a device including 5 metal oxide varistors (MOVs) designed to dissipate a power surge according to an embodiment of the present disclosure.

FIG. 1 is a cross-sectional view of a device 100 for dissipating a surge. The device 100 includes at least 3 metal oxide varistors (MOVs) 102 including a first outer MOV 104, a second outer MOV 106, and at least one inner MOV 107. In some embodiments, the at least one inner MOV 107 may include a first inner MOV 108, a second inner MOV 110, and a middle inner MOV 112. The middle inner MOV 112 may also be referred to as a center MOV as it is in the direct center of the MOVs 102. An X-Y-Z axis is shown throughout the drawings to illustrate the relative location of the components.

The first inner MOV 108 may be positioned between the first outer MOV 104 and the middle inner MOV 112. The second inner MOV 110 may be located between the second outer MOV 106 and the middle inner MOV 112. The middle inner MOV 112 may be located between the first inner MOV 108 and the second inner MOV 110.

Each of the at least 3 MOVs 102 may include two contact surfaces 114 with a compound 124 positioned therebetween. In some embodiments, the compound 124 may include zinc oxide (such as zinc oxide powder) bonded together with a bonding agent, such as one or more of bismuth or antimony, or may include silicon carbide. The contact surfaces 114 may be conductive.

Each of the first outer MOV 104 and the second outer MOV 106 may have an outer contact surface 116 and an inner contact surface 118. The inner contact surface 118 may be at least one of positioned adjacent to or touching a contact surface of an adjacent MOV. For example, the inner contact surface 118 may be in contact with a first contact surface 120 of the first inner MOV 108. The first inner MOV 108 may further include a second contact surface 122 that is in contact with a contact surface of the middle inner MOV 112. Adjacent contact surfaces 114 may be electrically connected together due to the contact therebetween.

Each of the MOVs 102 may be positioned or stacked adjacent to each other along the Z axis. In that regard, adjacent contact surfaces of adjacent MOVs 102 may be in contact with, and electrically connected to, each other.

Figure 2:
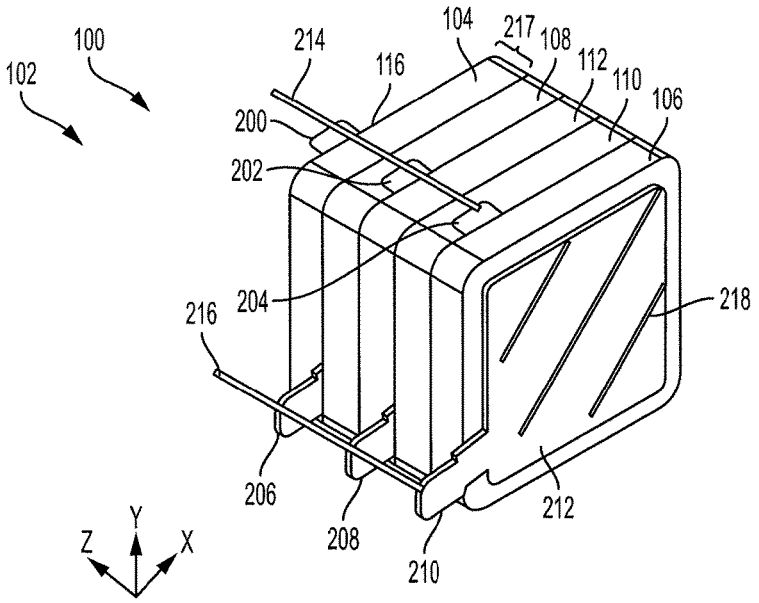
FIG. 2 is a perspective view of the device of FIG. 1 including a plurality of contacts connected to the MOVs and two connectors coupled to the contacts according to an embodiment of the present disclosure.

Referring to FIGS. 1 and 2, multiple contacts may be electrically coupled to the MOVs 102. In particular, a first contact 200 may be electrically connected to the outer contact surface 116 of the first outer MOV 104. A second contact 202 may be electrically connected to adjacent contact surfaces of the first inner MOV 108 and the middle inner MOV 112. A third contact 204 may be electrically connected to adjacent contact surfaces of the second inner MOV 110 and the second outer MOV 106. The first contact 200, the second contact 202, and the third contact 204 may be electrically connected to a first connector 214.

A fourth contact 206 may be electrically connected to adjacent contact surfaces of the first outer MOV 104 and the first inner MOV 108. A fifth contact may be electrically connected to adjacent contact surfaces of the middle inner MOV 112 and the second inner MOV 110. A sixth contact may be electrically connected to an outer contact surface 212 of the second outer MOV 106. The fourth contact 206, the fifth contact 208, and the sixth contact 210 may be electrically connected to a second connector 216. Contacts 200, 202, 204, 206, 208, and 210 may have openings (such as slots 218 or holes 400 of FIG. 4) to allow extra solder that is in contact with the MOVs 102 to escape during assembly.

In order to utilize the device 100 to provide surge protection capabilities, the device 100 may be electrically connected between an input signal line (such as a line that provides a voltage) and a neutral line. In that regard, the first connector 214 or the second connector 216 may be electrically connected to an input signal line, and the other of the first connector 214 or the second connector 216 may be electrically connected to a neutral line. In that regard, each of the MOVs 102 is connected in parallel.

For example, the first connector 214 may be electrically connected to an input line and the second connector 216 may be electrically connected to a neutral line. As a surge is received from the input line, the surge signal may be received by the MOVs 102 and dissipated as heat.

Figure 3:
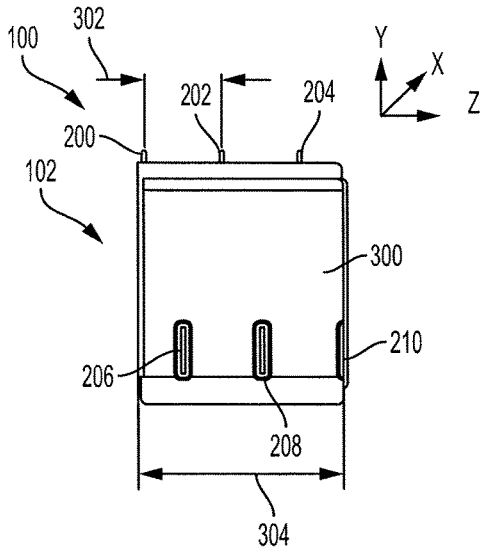
FIG. 3 is a side view of the device of FIG. 1 and illustrates an insulator or a housing surrounding the MOVs according to an embodiment of the present disclosure.
Figure 4:
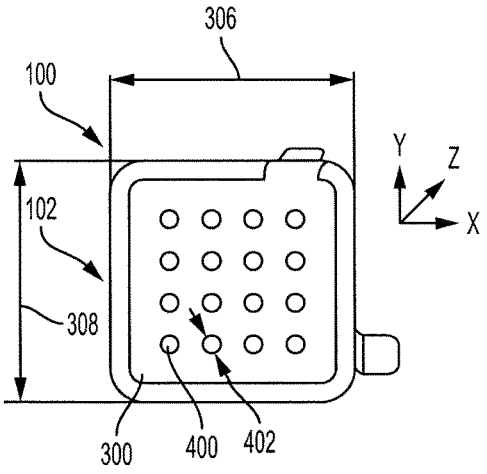
FIG. 4 is a front or back view of the device of FIG. 1 including the insulator of FIG. 3 that includes openings on the front or back according to an embodiment of the present disclosure.

Referring now to FIGS. 3 and 4, the device 100 may include an insulator 300. In some embodiments, the insulator 300 may be a housing for retaining the MOVs 102 in place relative to each other. The insulator 300 may include any insulating material. In some embodiments, the insulator 300 may include a coating, such as an epoxy coating, that coats the MOVs 102.

The insulator 300 may at least partially surround the MOVs 102. As shown, each of the contacts 200, 202, 204, 206, 208, and 210 may extend outward beyond the insulator 300. In some embodiments, a portion of some or all of the contacts 200, 202, 204, 206, 208, and 210 may also be insulated.

The contact 206 shown under the insulator 300 may include one or more openings 400 along the Z axis. Stated differently, the openings 400 may be located along the X-Y planes of each contact 200, 202, 204, 206, 208, and 210. The openings 400 may allow extra solder that is in contact with the MOVs 102 to escape during assembly of the device 100. It is desirable for a width 402 of the openings 400 to be less than a thickness 217 of each of the MOVs 102. For example, it may be desirable for the width 402 to be between 10 thousandths of an inch (mils, 0.25 millimeters (mm)) and 150 mils (3.81 mm), between 25 mils (0.64 mm) and 100 mils (2.54 mm), or about 78 mils (2 mm). Where used in this context, about refers to the stated value plus or minus 10 percent of the stated value.

The MOVs 102 may each have a thickness 217 of between 50 mils (1.27 mm) and 300 mils (7.62 mm), between 100 mils (2.54 mm) and 250 mils (6.35 mm), or about 197 mils (5 mm).

A distance 302 between each pair of adjacent contacts (such as between the contact 200 and the contact 202) may be between 100 mils (2.54 mm) and 600 mils (15.2 mm), between 200 mils (5.1 mm) and 500 mils (12.7 mm), or about 441 mils (11 mm).

The device 100 may have a distance 304 in the Z direction that is between 300 mils (7.62 mm) and 1,800 mils (45.7 mm), between 600 mils (15.24 mm) and 1,250 mils (31.75 mm), or about 1,181 mils (30 mm).

The device 100 may have a distance 306 in the X direction and a distance 308 in the Y direction that each may be between 787 mils (20 mm) and 1,970 mils (50 mm), 1180 mils (30 mm) and 1,575 mils (40 mm), or about 1,378 mils (35 mm).

Figure 5:
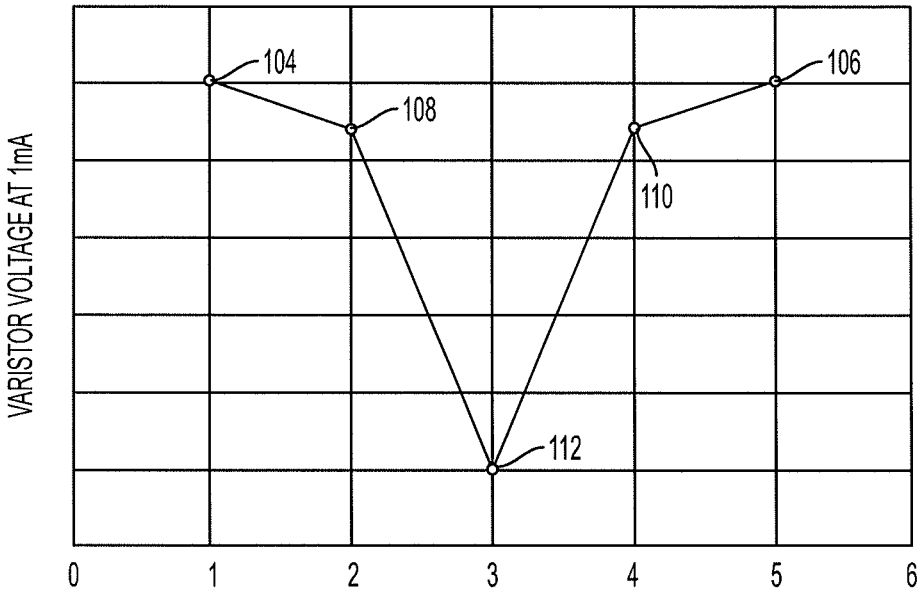
FIG. 5 is a plot illustrating exemplary rated voltages of each of the MOVs of the device of FIG. 1 at 1 mA of current to show that some of the MOVs are mismatched according to an embodiment of the present disclosure.

Referring to FIGS. 1 and 5, voltage of the MOVs 102 at a given current (such as 1 milliamp (1 mA) of current) is shown. It may be desirable for the voltage characteristics of at least some of the MOVs 102 to be mismatched. In particular, it may be desirable for at least one of the inner MOVs 107 to have a lower voltage at a given current value (such as at 1 mA) than one or both of the outer MOVs 104, 106 at the same given current value. In some embodiments, it may be desirable for the middle inner MOV 112 to have a lower voltage at the given current value (such as 1 mA) than the outer MOVs 104, 106.

The first outer MOV 104 and the second outer MOV 106 may have a first voltage at 1 mA. The first inner MOV 108 and the second inner MOV 110 may have a second voltage at 1 mA. In some embodiments, it may be desirable for the second voltage to be less than the first voltage. In some embodiments, it may be desirable for the second voltage to be the same as the first voltage.

The middle inner MOV 112 may have a third voltage at 1 mA. In some embodiments, it may be desirable for the third voltage to be less than the second voltage. For example, it may be desirable for the difference between the first voltage and the second voltage to be between 5 volts and 15 volts, or between 7 volts and 13 volts, or about 10 volts. As another example, it may be desirable for the difference between the first voltage and the third voltage to be between 25 volts and 75 volts, or between 35 volts and 65 volts, or about 50 volts.

In some embodiments, it may be desirable for a ratio between the third voltage and the first voltage to be between 30 to 40 and 39 to 40, or between 33 to 40 and 38 to 40, or about 36 to 40 (9 to 10).

Figure 6:
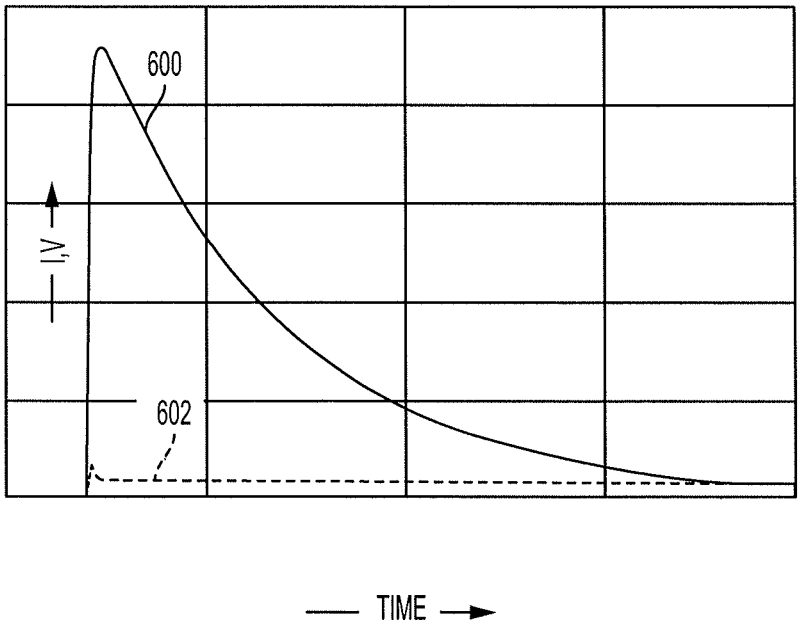
FIG. 6 is a plot illustrating conduction of current and resultant voltage applied to the device of FIG. 1 over a period of 2 milliseconds according to an embodiment of the present disclosure.

Referring now to FIGS. 1 and 6, current 600 and voltage 602 of the device 100 are shown over a period of time. The illustrated period of time is 2 milliseconds (ms). As shown, the device 100 conducts all of the received current over the 2 ms time period.

Figure 7:
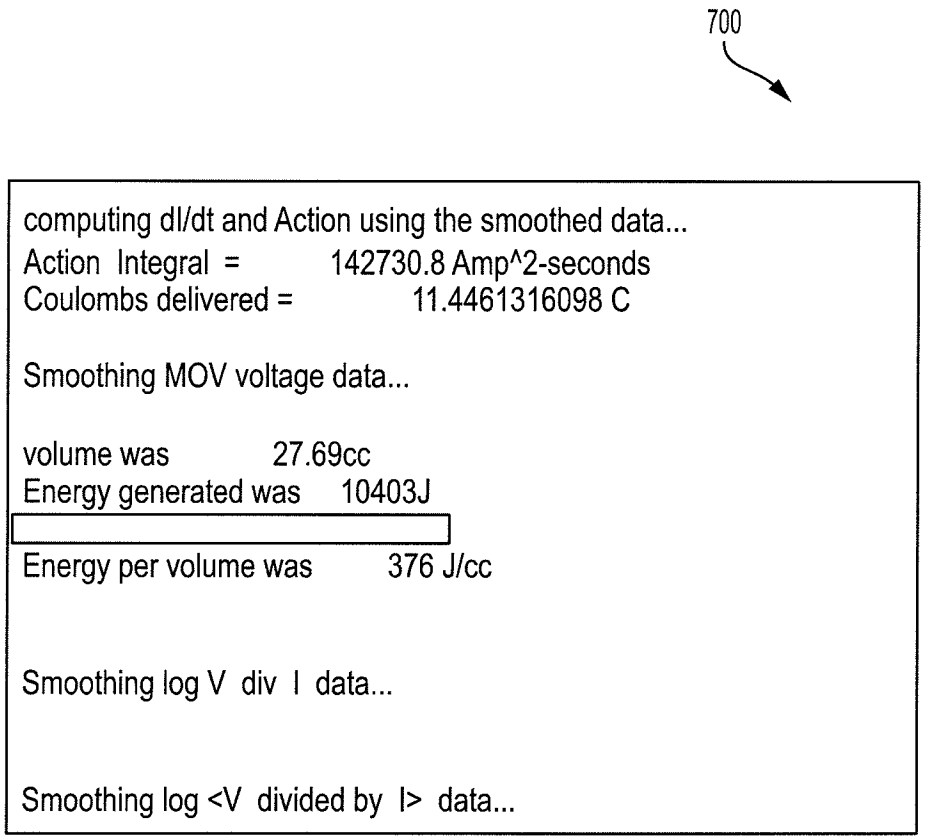
FIG. 7 illustrates results of experimental test data using the device of FIG. 1 according to an embodiment of the present disclosure.
Figure 8:
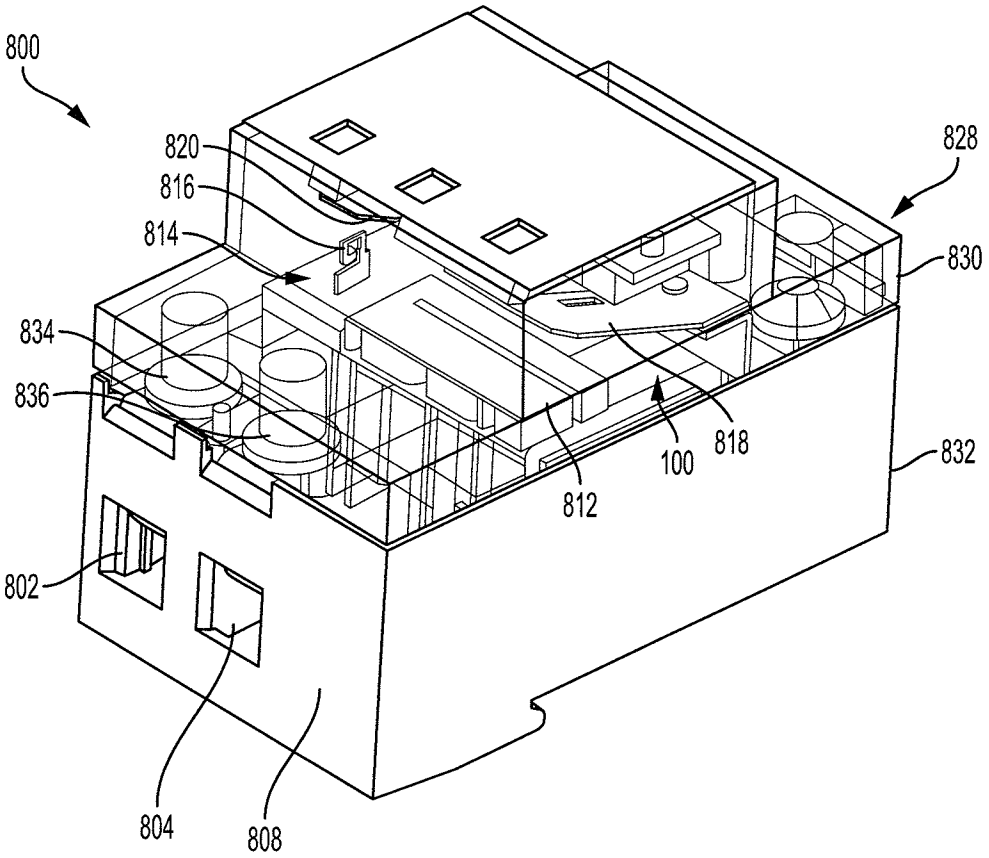
FIG. 8 is a perspective view of a surge suppression device that includes the MOV device of FIG. 1 with a housing that is partially transparent according to an embodiment of the present disclosure.
Figure 9:
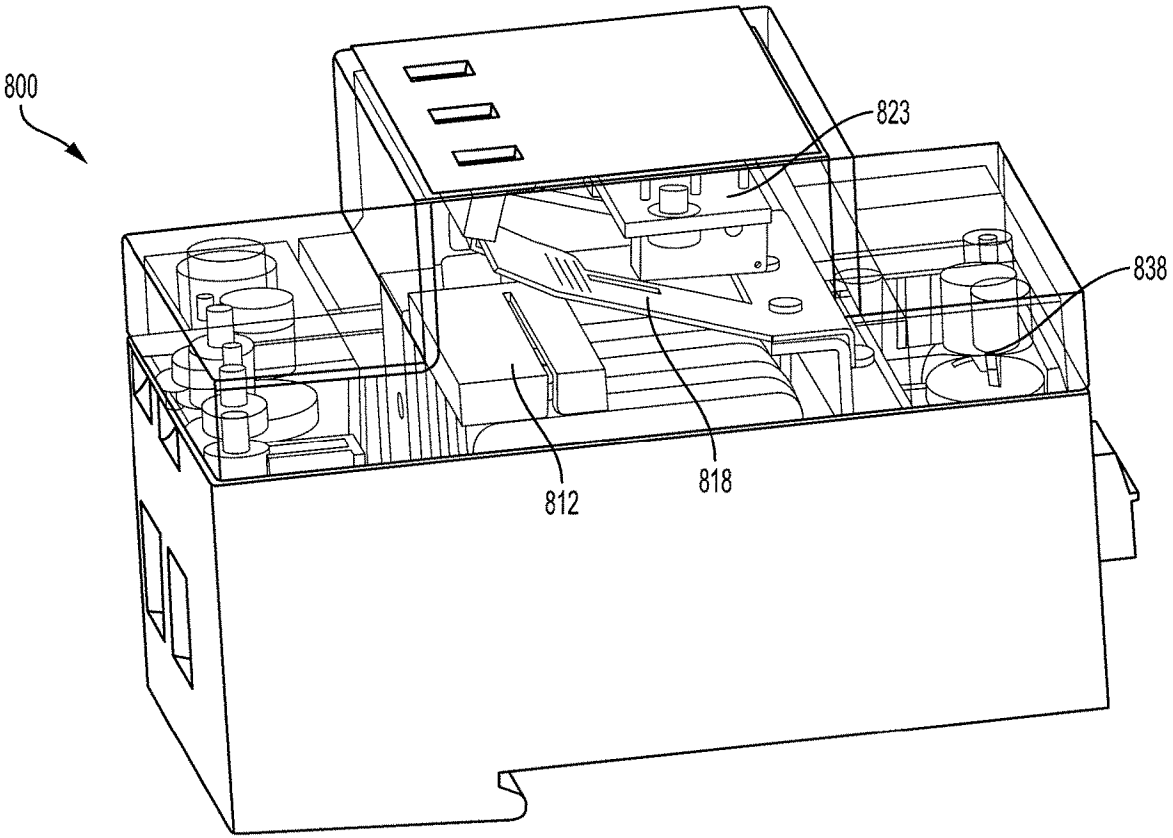
FIG. 9 is a side view of the surge suppression device of FIG. 8 with the partially transparent housing of FIG. 8 according to an embodiment of the present disclosure.
Figure 10:
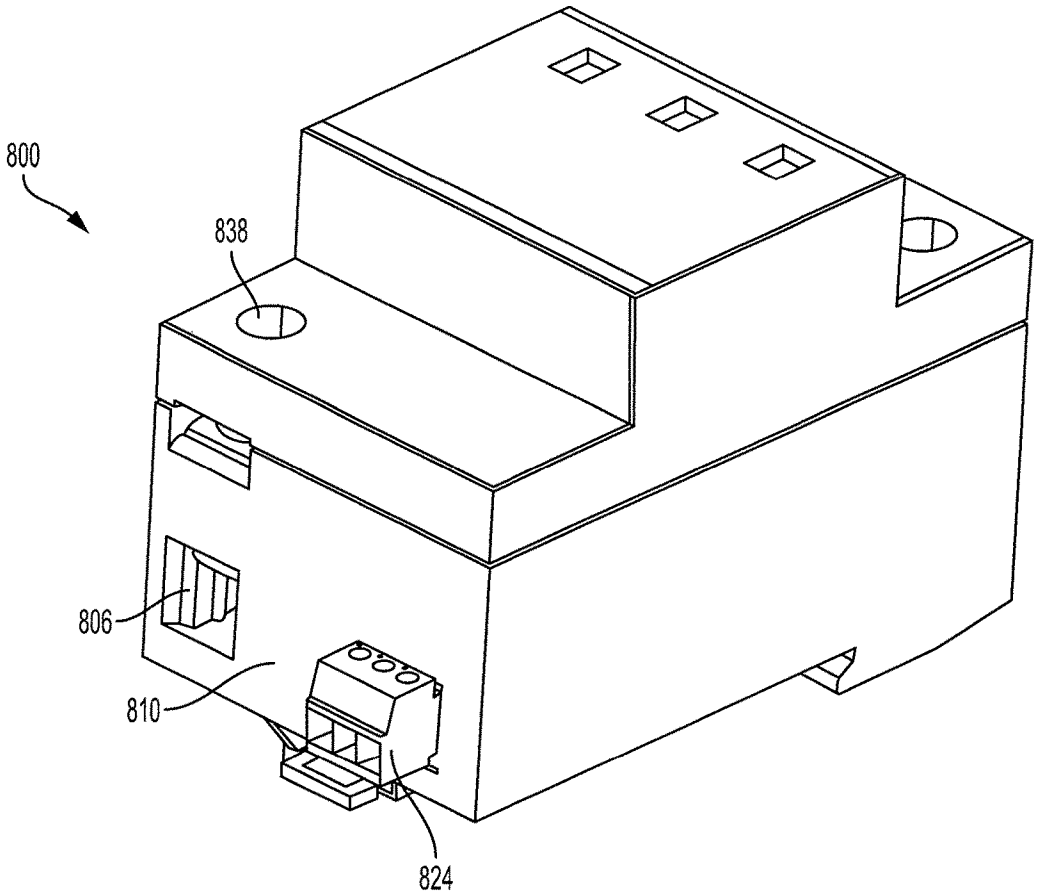
FIG. 10 is a perspective view of the surge suppression device of FIG. 8 with the housing shown as opaque according to an embodiment of the present disclosure.
Figure 11:
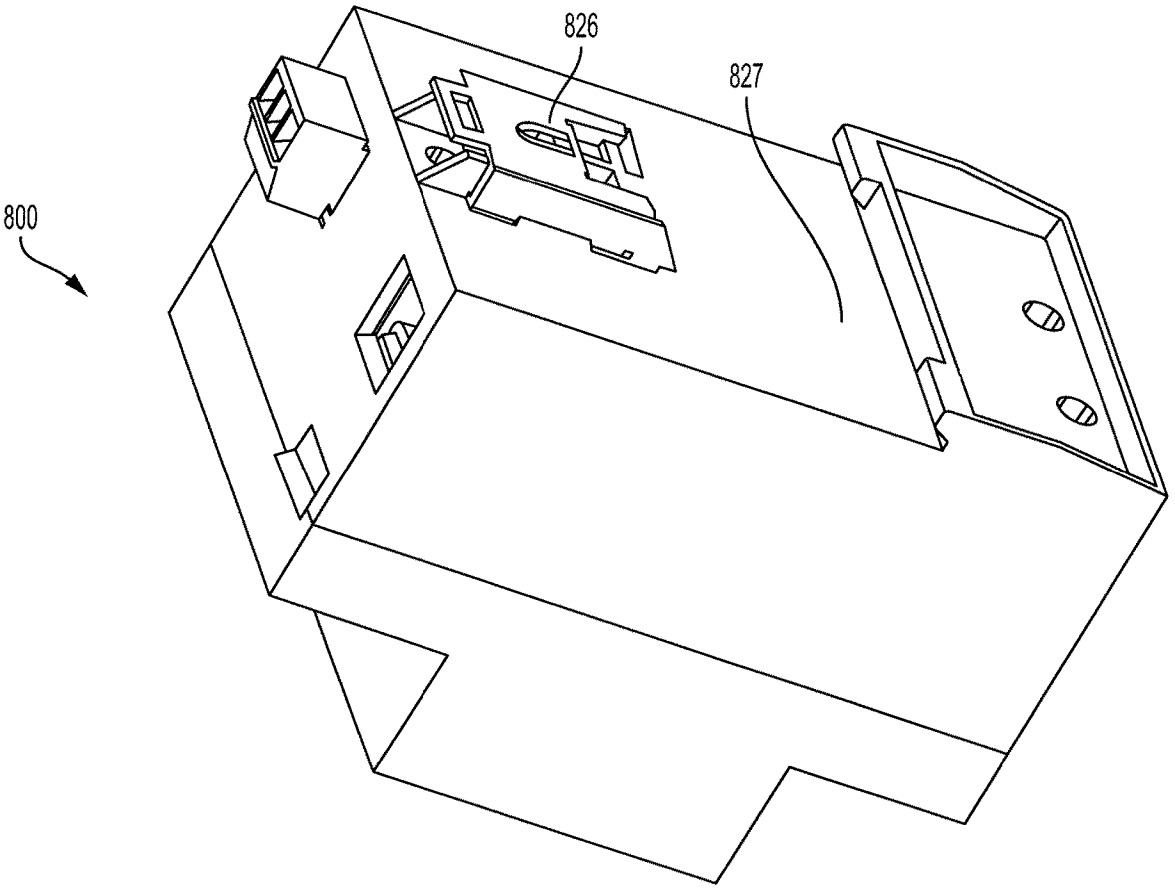
FIG. 11 is a perspective view illustrating a bottom of the surge suppression device of FIG. 8 according to an embodiment of the present disclosure.

Turning to FIGS. 1 and 7, results 700 of experimental data using the device 100 are shown. In the experimental results, each of the MOVs 102 is designed to dissipate 2000 Joules (2000 J) of energy. As shown, use of the device 100 with the mismatched MOVs 102 provides for a total energy dissipation of over 10,000 J. These results 700 illustrate that mismatching the voltages of the MOVs 102 at a given current value (such as 1 mA) allows the combination of the 5 MOVs 102 to dissipate an amount of energy equal to at least a sum of the rated dissipation of each of the MOVs 102.

A device 100 may include any quantity of MOVs 102. For example, a device may include 3 MOVs with a middle MOV having a lower voltage rating at a given current than outer MOVs. As another example, a device may include 7 MOVs with an inner middle MOV having a lower voltage rating at a given current than outer MOVs. In some embodiments, it may be desirable for the other middle MOVs to have a voltage rating at the given current that is less than the voltage rating of the outer MOVs at the given current. In some embodiments, it may be desirable for the other middle MOVs to have a voltage rating at the given current that is greater than the voltage rating of the inner middle MOV. In some embodiments, it may be desirable for the voltage rating at the given current to decrease between each MOV from the outer MOVs to the inner middle MOV.

Referring to FIGS. 8-11, the MOV device 100 may be included in a surge suppression device 800. Although the MOV device 100 includes 5 MOVs and is included in the surge suppression device 800, a MOV device according to the present disclosure may include any quantity of MOVs and may be included in any surge suppression device in which use of one or more MOV is proper.

The surge suppression device 800 includes 3 ports including a first input port 802, a second parallel-connected input port 804, and an output port 806. Each of the ports 802, 804, 806 may receive one of a line signal, a phase signal, or a neutral signal. The first input port 802 and the second input port 804 may be positioned on a first end 808 of the surge suppression device 800. The output port 806 may be positioned on a second end 810 of the surge suppression device 800.

A first thermal disconnect 812 may be located on top of the MOV device 100 and may be in contact with one or more of the MOVs of the device 100. A first spring 818 may be soldered to the first thermal disconnect 812. In that regard, as the MOV device 100 dissipates a surge or fault current (defined in IEC 61643-1), the power may be dissipated as heat. Stated differently, the MOV device 100 (i.e., each of the MOVs of the MOV device 100) may dissipate a surge or fault current (i.e., an abundance of current) as heat.

The heat may transfer through the first thermal disconnect 812 to the solder joint with the first spring 818. As a predetermined amount of heat is transferred through the first thermal disconnect 812, the solder joint may become loose, thus releasing the first spring 818, allowing it to spring (i.e., actuate) upward (i.e., away from the first thermal disconnect 812).

The surge suppression device 800 may further include a Silicon Carbide Surge Blocking (SCSB) circuit 814 (including Silicon Carbide JFETs and associated trigger circuit). The surge blocking circuit 814 may include one or more JFET that is configured to dissipate a surge signal. In some embodiments, the SCSB circuit 814 may include a series transformer. In some embodiments, the SCSB circuit 814 may be connected in series with an external load to be protected, may be connected in parallel with the MOV device 100 and connected in series with a transformer having a predetermined inductance value (i.e., as measured in Henries).

A second thermal disconnect 816 may be coupled to the SCSB circuit 814 and may be soldered to a second spring 820 using a solder joint. In that regard, as the SCSB circuit 814 dissipates a surge or fault current, the power may again be dissipated as heat. Stated differently, the SCSB circuit 814 may dissipate a surge or fault current as heat.

The heat generated by the SCSB circuit 814 as a result of the surge may transfer through the second thermal disconnect 816 to the solder joint with the second spring 820. As a predetermined amount of heat is transferred through the second thermal disconnect 816, the solder joint with the second spring 820 may become loose, thus releasing the second spring 822 and allowing it to spring upward.

The surge suppression device 800 may further include a detector circuit 823. The detector circuit 823 may be positioned in such a manner that either or both of the first spring 818 or the second spring 820 contacts the detector circuit 823 in response to springing upward (i.e., in response to the solder melting and releasing the corresponding spring 818, 820). The detector circuit 823 may be capable of detecting contact with one or both of the first spring 818 or the second spring 820. In response to detecting such contact, the detector circuit 823 may transmit a signal that indicates that the surge suppression device 800 has blocked a surge and that the surge suppression device 800 may require repair.

The surge suppression device 800 may further include a system status connector 824. The system status connector 824 may be connected to a computer or other device that monitors the status of the surge suppression device 800. The signal transmitted by the detector circuit 823 (the signal that indicates that the surge suppression device 800 may require repair) may travel through the system status connector 824 to the computer or other device that monitors the status of the surge suppression device 800. In that regard, the computer or other device may transmit an alert to an authorized repair person to inspect the surge suppression device 800.

In some embodiments, the detector circuit 823 may determine whether the MOV device 100 has heated the first thermal disconnect 812 to the point of releasing the first spring 818, whether the SCSB circuit 814 has heated the second thermal disconnect 816 to the point of releasing the second spring 820, or both. In that regard, the authorized repair person may be aware of whether one or both of the MOV device 100 or the SCSB circuit 814 should be replaced.

In some embodiments, the surge suppression device 800 may be designed to be removably coupled to a Deutsches Institut fur Normung (DIN) rail. In that regard, the surge suppression device 800 may include a mechanical connector 826 on a bottom 827 of the surge suppression device 800. The mechanical connector 826 may facilitate a mechanical connection between the surge suppression device 800 and the DIN rail. In some embodiments, the mechanical connector 826 may be used to permanently removably couple the surge suppression device 800 to the DIN rail.

The surge suppression device 800 may include a housing 828 for encapsulating or retaining components of the surge suppression device 800. The housing 828 may include a first portion 830 and a second portion 832. The first portion 830 and the second portion 832 may be removably coupled to each other. In that regard, the housing 828 may be referred to as a clamshell housing.

The surge suppression device 800 may include a plurality of screw holes including a first screw hole 834, a second screw hole 836, and a third screw hole 838. Each of the screw holes 834, 836, 838 may be designed to receive a screw or other fastener. Each of the screw holes 834, 836, 838 may be aligned with a corresponding input port 802, 804, 806. In that regard, as a screw is received by one of the screw holes 834, 836, 838, the screw may establish a connection between the surge suppression device 800 and an input cable or wire received by a corresponding input port 802, 804, 806.

The previous description of the disclosed examples is provided to enable any person of ordinary skill in the art to make or use the disclosed methods and apparatus. Various modifications to these examples will be readily apparent to those skilled in the art, and the principles defined herein may be applied to other examples without departing from the spirit or scope of the disclosed method and apparatus. The described embodiments are to be considered in all respects only as illustrative and not restrictive and the scope of the invention is, therefore, indicated by the appended claims rather than by the foregoing description. All changes which come within the meaning and range of equivalency of the claims are to be embraced within their scope.

What is claimed is:

1. A device for dissipating a surge comprising:

at least three metal oxide or silicon carbide varistors (MOVs) positioned adjacent to each other and each having two contact surfaces such that contact surfaces of adjacent MOVs are electrically connected together, the at least three MOVs including a first outer MOV, a second outer MOV, and at least one inner MOV positioned between the first outer MOV and the second outer MOV, the first outer MOV and the second outer MOV having a greater voltage at a given current than at least one of the at least one inner MOV;

a first connector electrically coupled to at least one of the at least three MOVs; and a second connector electrically coupled to at least another of the at least three MOVs.

2. The device of claim 1 wherein:

the at least one inner MOV includes a middle inner MOV, a first inner MOV located between the first outer MOV and the middle inner MOV, and a second inner MOV located between the second outer MOV and the middle inner MOV; and the two outer MOVs have the greater voltage at the 1 mA than the middle inner MOV.

3. The device of claim 2 further comprising:

a first contact electrically connected to an outer contact surface of the first outer MOV;

a second contact electrically connected to adjacent contact surfaces of the first inner MOV and the middle inner MOV;

a third contact electrically connected to the adjacent contact surfaces of the second inner MOV and the second outer MOV;

a fourth contact electrically connected to the adjacent contact surfaces of the first outer MOV and the first inner MOV;

a fifth contact electrically connected to the adjacent contact surfaces of the middle inner MOV and the second inner MOV; and a sixth contact electrically connected to the outer contact surface of the second outer MOV.

4. The device of claim 3 wherein:

the first connector is electrically connected to the first contact, the second contact, and the third contact;

the second connector is electrically connected to the fourth contact, the fifth contact, and the sixth contact;

the first connector or the second connector is electrically coupled to an input signal line; and the other of the first connector or the second connector is electrically coupled to a neutral line.

5. The device of claim 2 wherein:

the first outer MOV and the second outer MOV each have a first voltage at the 1 mA;

the first inner MOV and the second inner MOV each have a second voltage at the 1 mA that is less than or equal to the first voltage; and the middle inner MOV has a third voltage at the 1 mA that is less than the second voltage.

6. The device of claim 1 further comprising an insulator at least partially surrounding the at least three MOVs.

7. The device of claim 1 further comprising a surge suppression device that includes the at least 3 MOVs.

8. The device of claim 7 wherein the surge suppression device further includes:

a first thermal disconnect coupled to at least one of the at least 3 MOVs;

a first spring configured to be soldered to the first thermal disconnect such that the spring springs away from the at least one of the at least 3 MOVs in response to the at least 3 MOVs dissipating a predetermined amount of heat or in response to the first thermal disconnect dissipating the predetermined amount of heat; and a detector circuit configured to detect contact with the first spring and to transmit a signal indicating the contact with the first spring.

9. The device of claim 7 wherein the surge suppression device further includes:

a second thermal disconnect coupled to the SCSB;

a second spring configured to be soldered to the second thermal disconnect such that the second spring springs away from the SCSB in response to the SCSB or its series resistor dissipating a predetermined amount of heat or in response to the second thermal disconnect dissipating the predetermined amount of heat; and a detector circuit configured to detect contact with the second spring and to transmit a signal indicating contact with the second spring.

10. A device for dissipating an electrical surge comprising:

at least three metal oxide or silicon carbide varistors (MOVs) positioned adjacent to each other and electrically connected together in parallel and including two outer MOVs and at least one inner MOV that has less voltage at a given current than the two outer MOVs;

a first connector electrically coupled to at least one of the at least three MOVs and configured to be coupled to a signal line or a neutral line; and a second connector electrically coupled to at least another of the at least three MOVs and configured to be coupled to the other of the signal line or the neutral line.

11. The device of claim 10 wherein:

the at least one inner MOV includes a middle inner MOV, a first inner MOV located between the first outer MOV and the middle inner MOV, and a second inner MOV located between the second outer MOV and the middle inner MOV; and the two outer MOVs have the greater voltage at the given current than the middle inner MOV and include a first outer MOV and a second outer MOV.

12. The device of claim 11 further comprising:

a first contact electrically connected to an outer contact surface of the first outer MOV;

a second contact electrically connected to adjacent contact surfaces of the first inner MOV and the middle inner MOV;

a third contact electrically connected to the adjacent contact surfaces of the second inner MOV and the second outer MOV;

a fourth contact electrically connected to the adjacent contact surfaces of the first outer MOV and the first inner MOV;

a fifth contact electrically connected to the adjacent contact surfaces of the middle inner MOV and the second inner MOV; and a sixth contact electrically connected to the outer contact surface of the second outer MOV.

13. The device of claim 12 wherein:

the first connector is electrically connected to the first contact, the second contact, and the third contact;

the second connector is electrically connected to the fourth contact, the fifth contact, and the sixth contact;

the first connector or the second connector is electrically coupled to the signal line; and the other of the first connector or the second connector is electrically coupled to the neutral line.

14. The device of claim 12 further comprising an epoxy coating applied to outer surfaces of each of the at least three MOVs and outer surfaces of each of the first contact, the second contact, the third contact, the fourth contact, the fifth contact, and the sixth contact to reduce the likelihood of sparking between contacts.

15. The device of claim 12 wherein at least the first contact and the sixth contact define openings to allow solder to escape during manufacture of the device.

16. The device of claim 11 wherein:

the two outer MOVs each have a first voltage at the given current;

the first inner MOV and the second inner MOV each have a second voltage at the given current that is less than or equal to the first voltage; and the middle inner MOV has a third voltage at the given current that is less than the second voltage.

17. A device for dissipating a surge comprising:

at least three metal oxide or silicon carbide varistors (MOVs) positioned adjacent to each other and including a first outer MOV, a second outer MOV, and a center MOV having a greater voltage at a given current than the first outer MOV and the second outer MOV;

a plurality of contacts including a first contact electrically connected to an outer contact surface of the first outer MOV, a second contact electrically connected to the outer contact surface of the second outer MOV, and additional contacts located between each adjacent pair of MOVs;

a first connector electrically coupled to a first group of the plurality of contacts; and a second connector electrically coupled to a second group of the plurality of contacts such that the at least three MOVs are electrically connected in parallel.

18. The device of claim 17 further comprising an insulator at least partially surrounding the at least three MOVs.

19. The device of claim 18 wherein the insulator includes an epoxy coating applied to outer surfaces of each of the at least three MOVs and outer surfaces of each of the plurality of contacts to reduce the likelihood of sparking between contacts.

20. The device of claim 17 wherein at least some of the plurality of contacts define openings to allow solder to escape during manufacture of the device.

* * * * *